US006860089B2

(12) United States Patent
VanAlstine

(10) Patent No.: US 6,860,089 B2
(45) Date of Patent: Mar. 1, 2005

(54) PILLOW PACK WRAPPING TECHNIQUE AND RELATED APPARATUS

(75) Inventor: Terrance VanAlstine, Palatine Bridge, NY (US)

(73) Assignee: Detail Machine Company, Palatine Bridge, NY (US)

( * ) Notice: Subject to any disclaimer, the term of this patent is extended or adjusted under 35 U.S.C. 154(b) by 0 days.

(21) Appl. No.: 10/410,528

(22) Filed: Apr. 9, 2003

(65) Prior Publication Data

US 2003/0192287 A1 Oct. 16, 2003

Related U.S. Application Data

(60) Provisional application No. 60/372,354, filed on Apr. 10, 2002.

(51) Int. Cl.[7] ..... B65B 11/42; B65B 51/10; B65B 51/22

(52) U.S. Cl. ..... 53/466; 53/234; 53/374.9

(58) Field of Search ..... 53/412, 463, 466, 53/234, 373.8, 374.9

(56) References Cited

U.S. PATENT DOCUMENTS

| | | | | | |
|---|---|---|---|---|---|
| 181,497 | A | * | 8/1876 | Milmoe | 53/234 |
| 1,187,055 | A | * | 6/1916 | Ferguson | 53/225 |
| 2,196,666 | A | * | 4/1940 | George | 53/234 |
| T0,920,006 | I4 | * | 3/1974 | Schoening | 53/387.3 |
| 4,202,151 | A | * | 5/1980 | Focke et al. | 53/234 |
| 4,495,745 | A | * | 1/1985 | Crescenzo et al. | 53/234 |
| 4,581,004 | A | * | 4/1986 | Nagata | 53/234 |
| 4,610,124 | A | * | 9/1986 | Watanabe et al. | 53/399 |
| 4,617,782 | A | * | 10/1986 | Mattei et al. | 53/234 |
| 4,648,236 | A | * | 3/1987 | Knecht | 53/234 |
| 5,210,992 | A | * | 5/1993 | Focke | 53/387.3 |
| 5,249,416 | A | * | 10/1993 | Adams et al. | 53/463 |
| 5,775,063 | A | * | 7/1998 | Ikai et al. | 53/463 |
| 6,263,644 | B1 | * | 7/2001 | Ghini et al. | 53/463 |

FOREIGN PATENT DOCUMENTS

| | | | | |
|---|---|---|---|---|
| JP | 63-294317 | * | 12/1988 | 53/234 |

* cited by examiner

*Primary Examiner*—John Sipos
(74) *Attorney, Agent, or Firm*—Wall Marjama & Bilinski LLP

(57) ABSTRACT

A method for hermetically sealing a bulk article wherein a strip of wrapping material is initially positioned onto an article such that extending ends of the wrapping material strip extend from away from an edge of the article, each end having a different length. The article is rotated to cause the ends of the strip to cover an uncovered side of the article with a fin-like section extending therefrom away from the article which can be sealed without contacting the article. The fin-like section is cooled and folded onto the top of the article so as to form an axial seam. Lateral ends of the wrapping material strip are then sealed to complete the hermetic sealing process.

11 Claims, 5 Drawing Sheets

PILLOW PACK WRAPPING TECHNIQUE AND RELATED APPARATUS

CROSS REFERENCE TO RELATED APPLICATIONS

This application claims priority under 35 USC §119 from provisional application, U.S. Ser. No. 60/372,354, filed Apr. 10, 2002, the entire contents of which are herein incorporated by reference.

FIELD OF THE INVENTION

This invention relates to the field of packaging, and in particular to a method for hermetically wrapping bulk articles, such as confectionaries and pharmaceutical products, among others.

BACKGROUND OF THE INVENTION

Hermetic wraps, such as so-called "pillow" wraps, have been developed to more or less hermetically seal a wrapped bulk article such as candies, gum and the like. To date, these wraps have been performed on horizontal wrapping machines which require a significant footprint and are expensive to maintain and install.

Rotary cut and wrapping machines, on the other hand, which do not require as significant a footprint as the above horizontal wrapping machines have been used to package confections, chews, bubble gum and the like. These machines utilize sealing methods that have been limited to various die fold end wraps, twist wraps, turned under fold single point wraps and the like. To date, existing rotary wrapping machines have not been able to produce a "pillow type" hermetic seal or wrap at cost-effective speeds exceeding 500 pieces per minute.

SUMMARY OF THE INVENTION

It is a primary object of the present invention to overcome the above-noted deficiencies of the prior art.

It is another primary object of the present invention to develop a more efficient method for wrapping bulk articles, such as, for example, confectionaries and pharmaceutical products.

Therefore and according to one aspect of the invention there is disclosed a method of wrapping a bulk article, said method including the steps of:

- placing a bulk article in wrapping material, said wrapping material being defined as a strip having ends extending over respective sides of said article and beyond the edges of the article, each of the extending ends of said strip having different lengths;
- folding each of said extending edges of said strip over one edge of the article, so as to define a fin-like section;
- heat sealing the fin-like section to define an axial seam wherein said fin-like section is sealed away from the wrapped article; and
- sealing the lateral ends of the wrapping strip so as to define a hermetic seal about the article.

The article can include a variety of items, including but not limited to hard and soft chewy candies, gum, foodstuffs, and pharmaceutical (human and veterinary) products.

According to another aspect of the invention, there is described an apparatus for wrapping at least one bulk article, said apparatus including a rotary wheel having a plurality of pockets along an outer periphery thereof, said wheel being supported for rotation about a center axis of the wheel. A bulk article is fed into a first pocket of said wheel and into a strip of wrapping material. The strip of wrapping material is sized to be fitted about the periphery of the article and includes a pair of ends of dissimilar length extending from respective sides of the article. The article is then rotated to a second position by the pocket wheel which folds each of the ends of the wrapping material strip over an edge of the article and forms a fin-like section extending away from the article.

Preferably, a heater is provided adjacent to one of said pockets for heat sealing this fin-like section of wrapping material. This sealing operation does not require contact with the article being wrapped and therefore no heat or pressure is imparted to the article, but only to the fin-like section. In lieu of heat sealing, other sealing means, such as ultrasonic welding and/or pressure sensitive cold seals, can be utilized.

The formed seal is then cooled at a subsequent operation, such as by means of a water chiller or other appropriate apparatus. The article is then removed from the pocket wheel and the fin-like seal is folded over onto the top of the product which is then conveyed through an end seal apparatus to complete the hermetic seal operation.

An advantage of the above wrapping method is that a seal is created which extends away from the product permitting heat contact over substantially an entire major dimension (e.g., length, width) of the wrapped product.

These and other objects, features and advantages will be readily understood from the following Detailed Description which should be read in conjunction with the accompanying drawings.

DETAILED DESCRIPTION

The following description relates to a specific apparatus for performing the present wrapping method. It will be readily apparent from the discussion that follows that other machinery can be used to create wrapped articles as described herein. The example shown herein relates to a rectangularly shaped bulk article, such as candy or gum but the herein defined wrapping method can easily be applied to articles of varying shapes and configurations.

Figure 1:
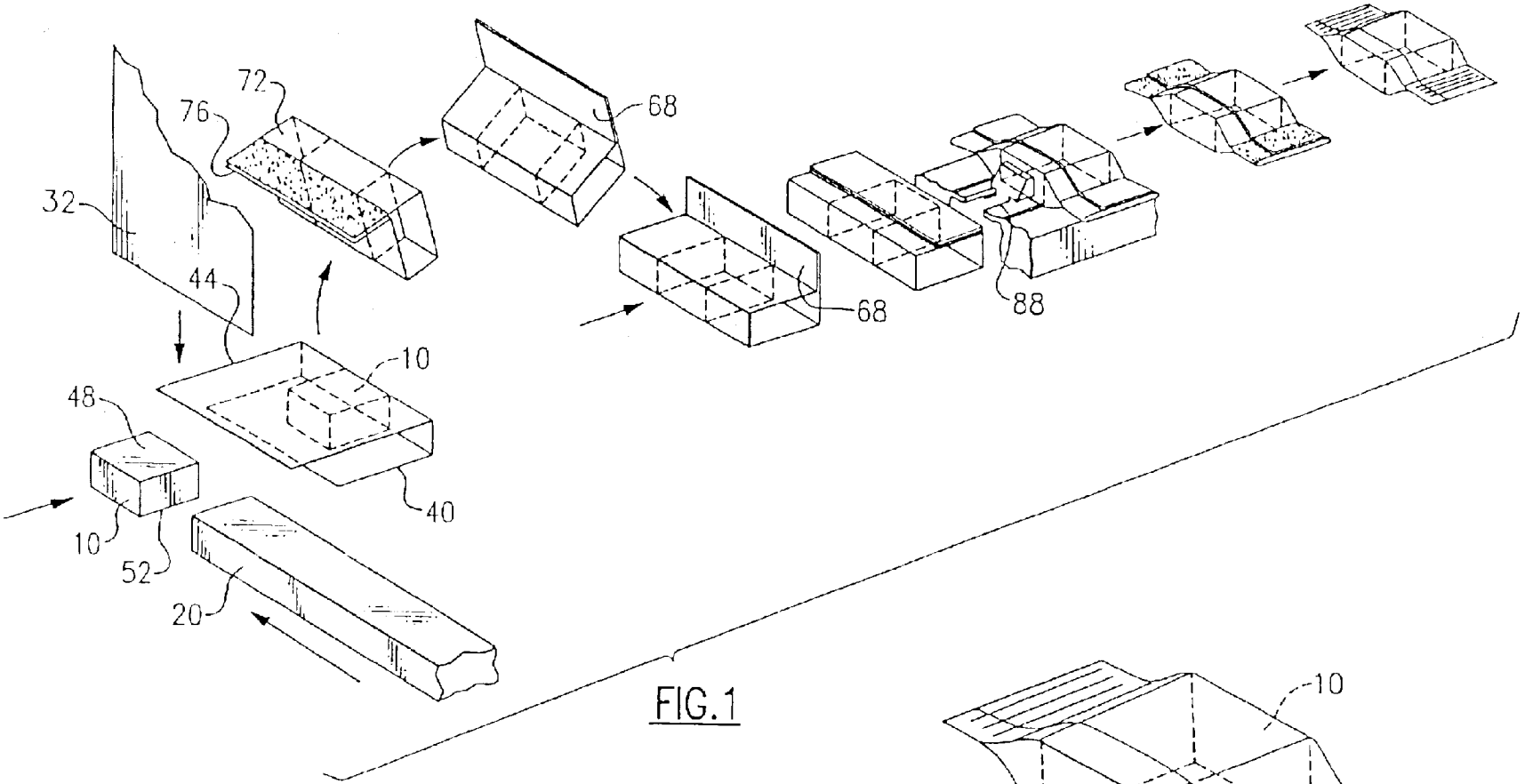
FIG. 1 is a pictorial view of a wrapping method for a bulk article in accordance with a preferred embodiment of the invention.
Figure 2A:
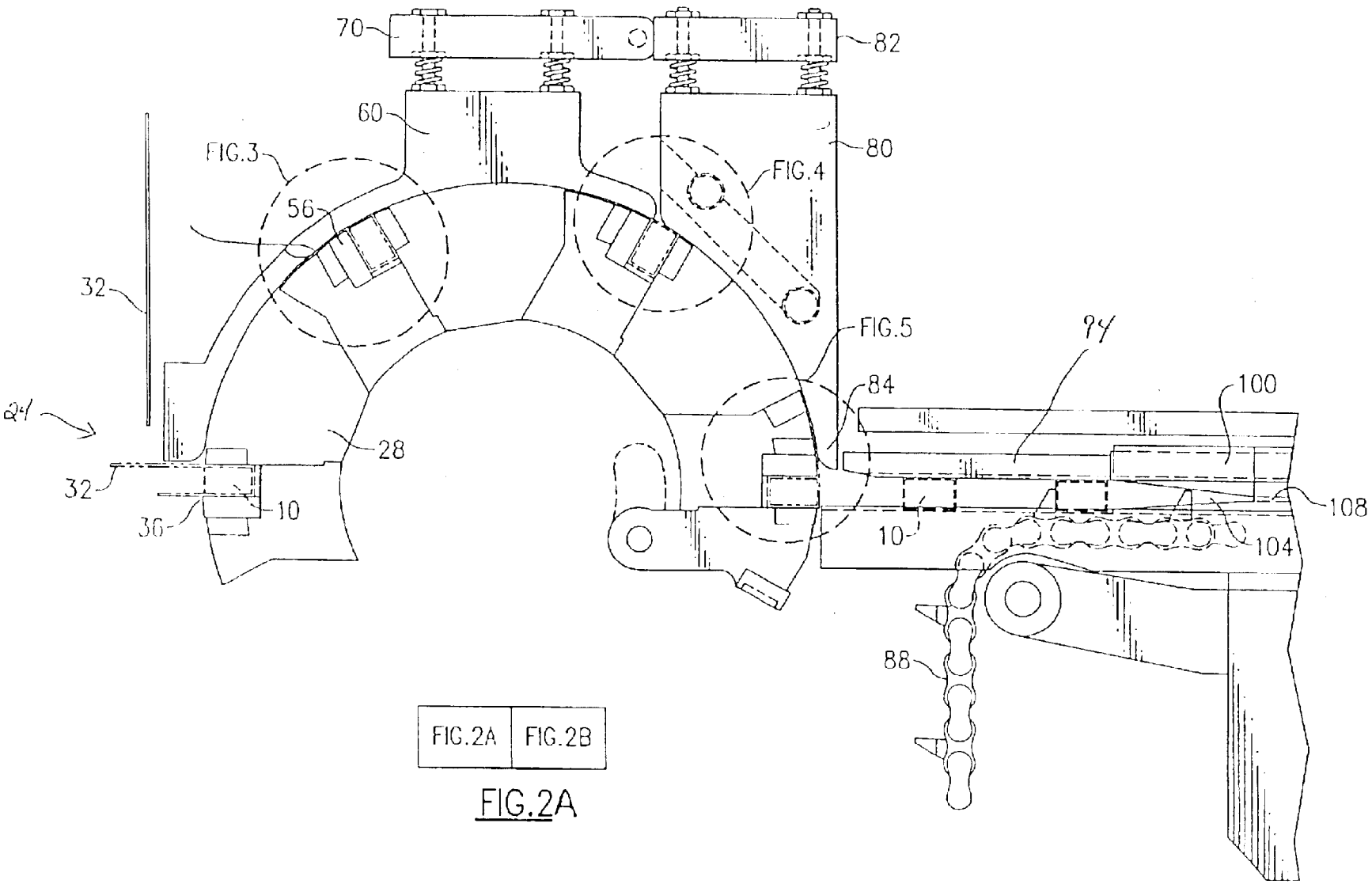
FIGS. 2A and 2B are side elevational views of a wrapping apparatus used for carrying out the wrapping method of FIG. 1.
Figure 2B:
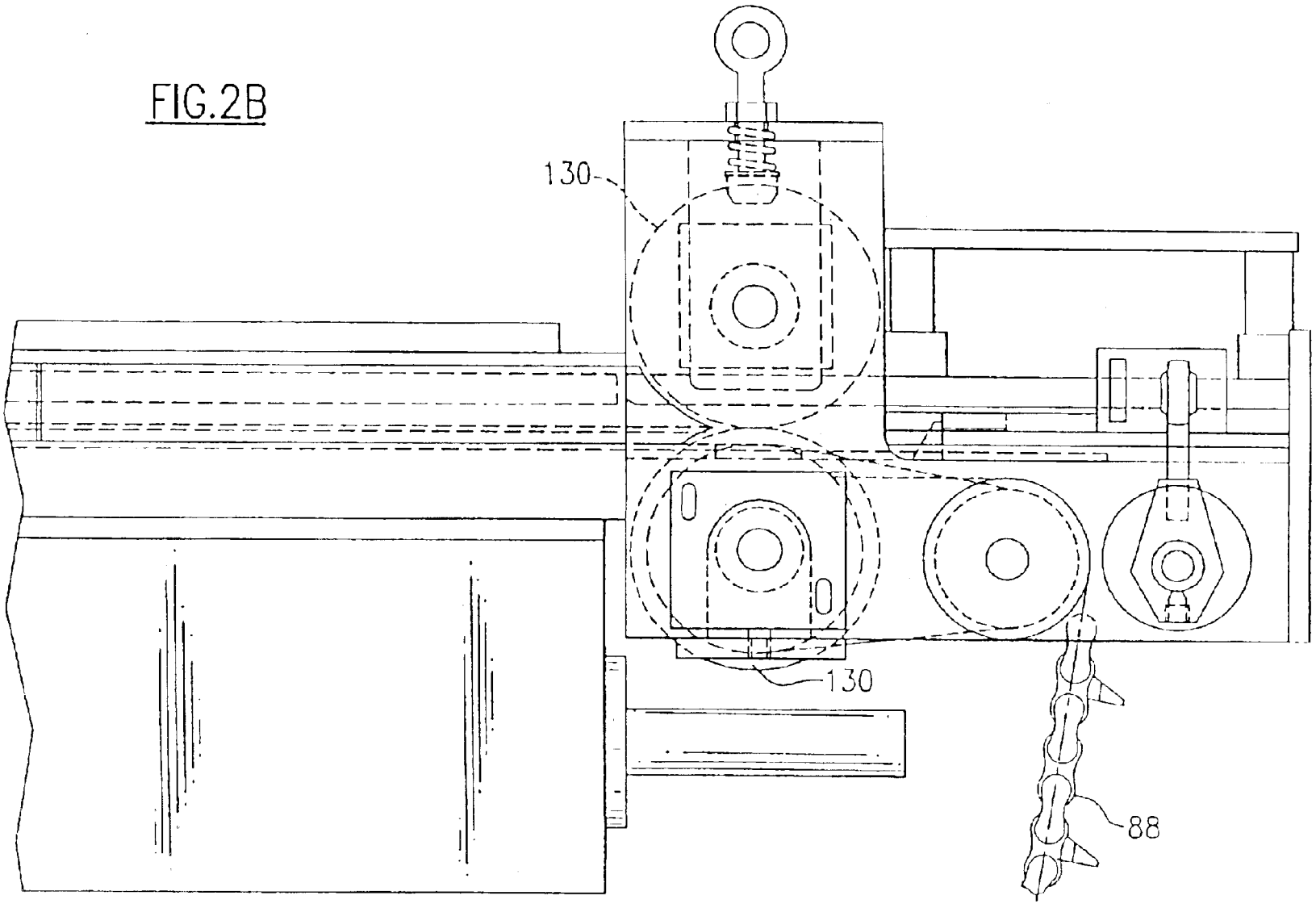
Figure 3:
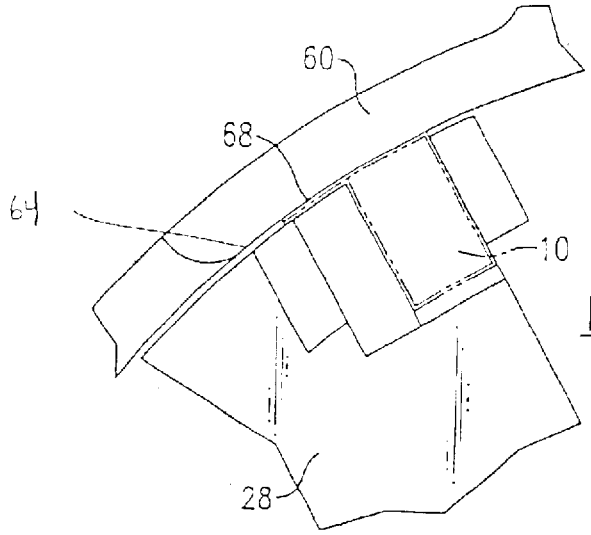
FIG. 3 is an enlarged view of a pocket wheel station shown in FIG. 2A, illustrating the heat sealing of a fin section of the bulk article depicted in FIG. 1.

Referring to FIG. 1, there is shown a pictorial view of the wrapping method in accordance with the present invention. A bulk article 10, such as a continuous section of chocolate, caramel, or other confectionary or other material of example, such as fudge or dough, is first cut into a rectangular configuration from a feed line 20 through conventional means, such as a cutting blade (not shown). Referring to FIGS. 1 and 2A, the bulk article 10, after being cutting into its rectilinear shape, is horizontally shuttled to a cut and wrap station, shown generally as 24, adjacent a rotatable pocket wheel 28. The cut and wrap station 24 is modified to allow a strip of wrapping material 32 to be fed from a supply of wrapping material (not shown) prior to the article 10 being pushed horizontally into a rotary folding box 36 of the pocket wheel 28. The wrapping material 32 is composed of polyethylene, mylar, wax paper, foil or other suitable film material and typically includes a heat activated adhesive usually coated on the inside of the material which can include printed material on the outside surface thereof. The herein-described pocket wheel 28 includes a plurality of rotary folding boxes 36 disposed arcuately about the wheel, defining a number of take-up positions for bulk articles 10 as the wheel is caused to rotate through a central mechanism (not shown). As shown in FIG. 1, first and second folds 40, 44 of the wrapping material strip 32 are created around the bulk article 10 along respective edges 48 and 52.

The strip of wrapping material 32 that is provided is sized such that an additional amount of wrapping material remains outside of the rotary folding box 36 on each of the edges of the bulk article 10 to be wrapped, permitting this material to be folded back upon itself. Preferably, the material 32 is at least half the width of the product shape in a double thickness as required in a subsequent step.

Each rotary folding box 36 of the pocket wheel 28 of the herein described apparatus is preferably equipped with a pressure block 56 that is attached to the back of each pocket. This block 56 is made sufficiently wide, intentionally exceeding the desired width of the wrapping material and having a radial length sufficient to backup the overlap of material protruding from it when the bulk article 10 and the material are clamped together into contact.

As shown in FIGS. 1–4, the partially wrapped article 10 is then caused to index with the pocket wheel 28 within the folding box 36 and rotate through a series of consecutive stations of the apparatus. At first station approximately 90 degrees from the original wrap and cut station 24, a heater 60 heaving a concave contact surface 64 is disposed in relation to the pocket wheel 28, shown more particularly in FIG. 3. The heater 60 includes a spring loaded mechanism 70 that acts to press onto and heat the overlapped material inside the pressure block 56 it rests upon. This allows the heat seal to occur away from the formed product and more specifically behind and away from the bulk article 10. The heat seal forms a fin-like section 68, shown more particularly in FIG. 1, which defines an axial seam as well as respective third and fourth folds 72, 76. In lieu of a heat seal, the seam can be formed using an ultrasonic horn (not shown) and a welding process.

Figure 4:
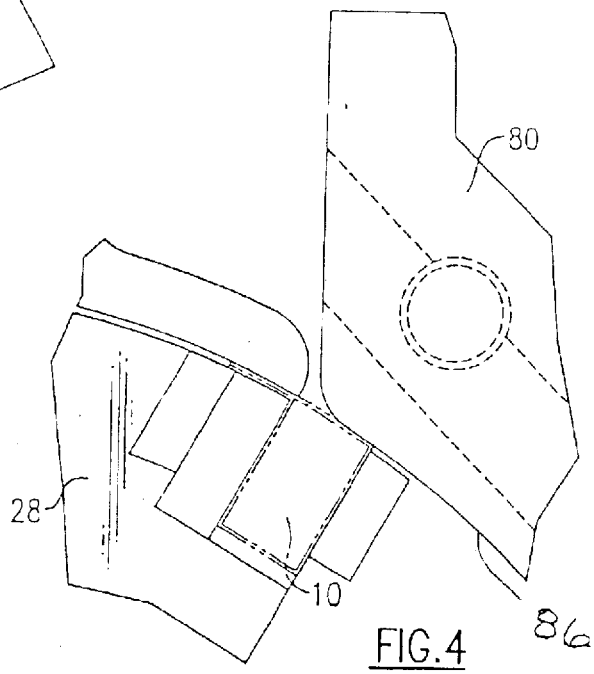
FIG. 4 is an enlarged view of a pocket wheel station subsequent to that of FIG. 3, illustrating a cooling operation of the bulk article.

After a given number of indexing operations, the bulk article 10 is pinched using a similar spring-loaded mechanism 82 similar to that described above relative to a water-chilled concave cooling station 80 having a similar contact surface 86. This cooling operation sets the long axial adhesive of the seam of the defined fin section as shown in FIG. 4, as the wheel rotates past the contact surface 86 thereof.

Figure 5:
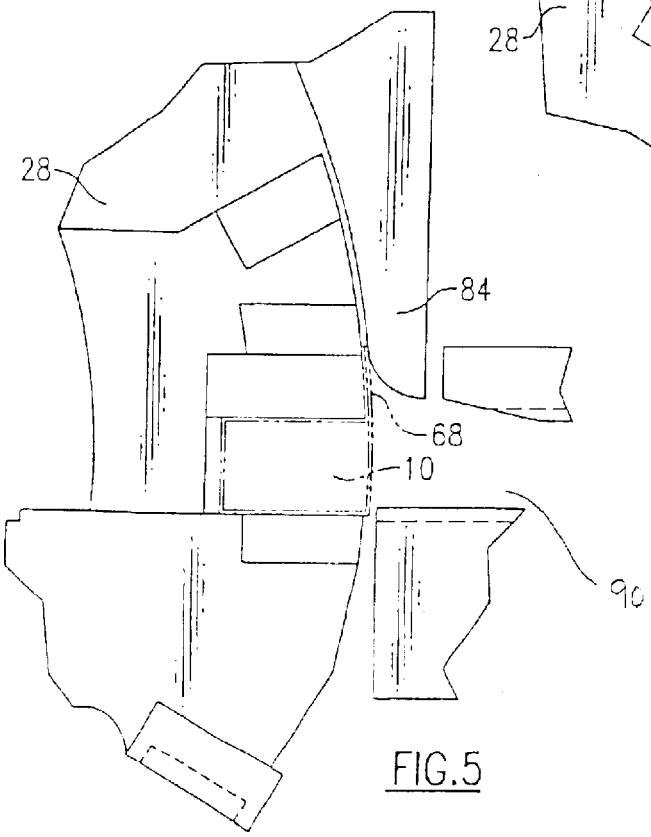
FIG. 5 is an enlarged view of a subsequent pocket wheel station which provides an exit for the bulk article.

The wrapped package then proceeds incrementally to an exit position or station 90, shown in FIG. 5, from the rotating folding box 36 of the pocket wheel 28 and dwells horizontally. In this position as conveyed, the axial seam is now turned over 180 degrees from the sealed positions described above, and is "above" the product.

As the wrapped bulk article 10 is extracted from the rotary folding box of the pocket wheel 28, the product is passed beneath a heel 84 of the concave surface of the cooling station 80. Simultaneously, the long seam of the fin-like section 68 is pushed onto the top of the exiting product, thereby creating a final fold.

As the wrapped bulk article 10 emerges from under the heel 84 of the cooling block and exits the rotatable pocket wheel 28, the article is placed within a chain lug style conveyor 88 disposed between a shallow track and a spring loaded hold-down bar 94, which keeps the partially wrapped article 10 in place throughout a plurality of various end seal positions.

Figure 6:
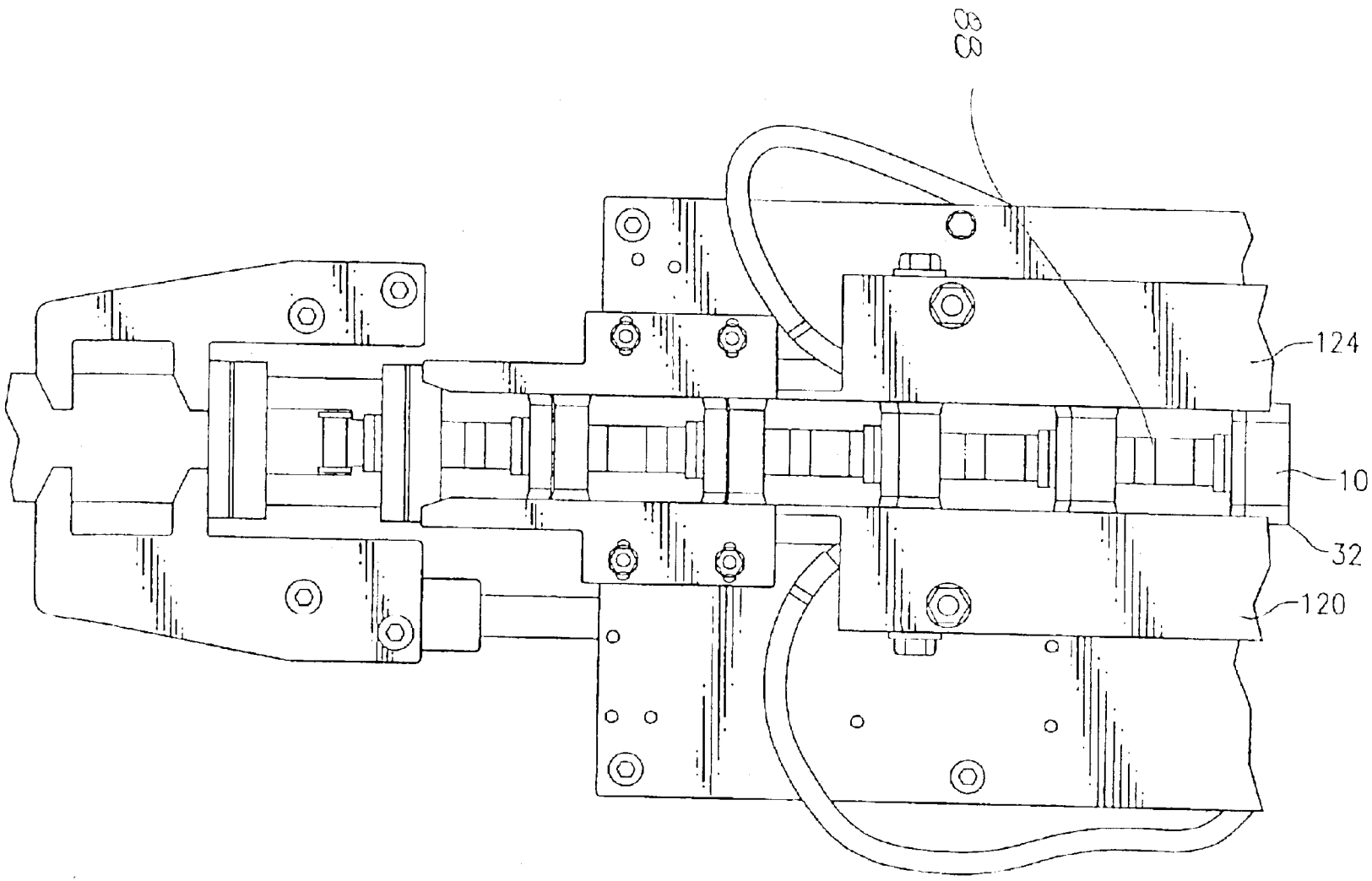
FIG. 6 is a partial top view of the end sealing portion of the apparatus of FIGS. 2A and 2B.

Once located within the chain lug conveyor 88, the wrapped article 10 is pushed between a pair of package endformers 100, situated on each lateral side thereof as shown in FIG. 6. These endformers 100 are machined with respective lead-ins 104 that are used to capture the lateral ends of wrapping material 32 and to guide the ends which are closed between a set of narrow slots 108. This operation, as shown in FIG. 6, flattens and spreads each end of the wrapping material 32 into a bow tie-like shape extending approximately halfway up the ends of the bulk article 10.

After the lateral ends of the wrapped product have been flattened and shaped, each bulk article 10 is moved into an end heat portion 112 of the wrapping apparatus. In this portion, the ends of the wrapped bulk article 10 are moved through closely fitted slots 116 that have been machined into a pair of metal blocks 120, 124. These blocks 120, 124 are heated, for example, by electrical resistance type heaters (not shown), that are controlled by self-monitoring heat controllers (not shown). The heater blocks 120, 124 are preferably contained with temperature sensors in a conventional manner that report the achieved temperature to the control station through a feedback circuit which determines whether more or less heat is required. As the wrapped bulk article 10 passes through the slotted heated portions, the lateral ends of the wrapped bulk article 10 are subjected to a predetermined amount of heat over the length of the heater blocks 120, 124.

As a result of the above heating operation, the adhesive material on the interior of the ends of the wrapping material of the bulk article 10 is melted and gently pressed together and held in the above preformed bow tie shape. The heater blocks 120, 124 are preferably mounted with fasteners through lateral slots that permit adjustment of the distance from the heaters to the actual product in the wrapping apparatus. Significant to the present invention, the above operation allows only the end wrapping material to be pressed against the heaters, and not the actual contained product.

After a predetermined amount of heater length, the end seal areas of the wrapped article 10 are resented between a pair of counter rotating end crimpers 130, driven by the control system to a specific surface speed. These crimpers 130 provide the pressure required to set a firm seal with various style impressions being left on the ends. The long seam is tacked down at each end of the bulk article 10 by leaving a slight amount of length on the outer layer of exposed wrapping material, thereby completing the wrapping operation. For very poor heat conducting films and laminated wrapping materials, additional heaters may be applied to the crimpers.

Figure 7:
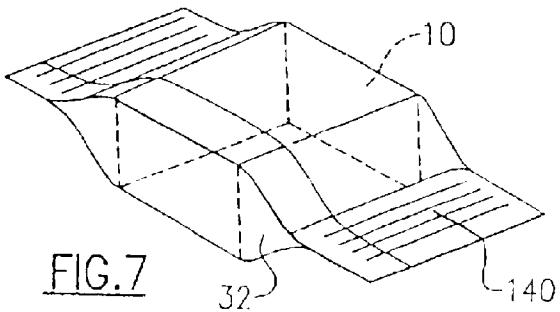
FIG. 7 is a perspective view of a bulk article employing the wrapping method of FIG. 1.

Preferably, a reciprocating nip blade is provided in order to cut a small mark 140 or notch length wise into one end of the wrapped article 10 to permit easy opening by the consumer, such as shown in FIG. 7.

While the present invention has been particularly shown and described with reference to the preferred mode as illustrated in the drawing, it will be understood by one skilled in the art that various changes in detail may be effected therein without departing from the spirit and scope of the invention as defined by the claims.

For example, the above equipment could also be utilized to wrap product having cold seal films. For this instance, the above described heater and chiller stations would simply be turned off and a label registration/cut/timing system (not shown) would be added to the cut and wrap station 24.

PART LIST FOR FIGS. 1–7

| | |
|---|---|
| 10 | bulk article |
| 20 | feed line |
| 24 | cut and wrap station |
| 28 | rotatable pocket wheel |
| 32 | wrapping material |
| 36 | rotary folding box |
| 40 | first fold |
| 44 | second fold |
| 48 | edge |
| 52 | edge |
| 56 | pressure block |
| 60 | heater |
| 64 | concave contact surface |
| 68 | fin-like section |
| 70 | spring loaded mechanism |
| 72 | third fold |
| 76 | fourth fold |
| 80 | cooling station |
| 82 | spring loaded mechanism |
| 84 | heel |
| 86 | contact surface |
| 88 | conveyor |
| 90 | exit station |
| 94 | hold down bar |
| 100 | end formers |
| 104 | lead-ins |
| 108 | slots |
| 112 | end heat portion |
| 116 | slots |
| 120 | block |
| 124 | block |
| 130 | crimper |
| 140 | slot/notch |

It will be readily apparent to one of sufficient skill in the field that certain modifications and variations covering the inventive concepts are possible as recited in the following claims:

What is claimed is:

1. A method for hermetically wrapping a bulk article on an apparatus comprising a rotary pocket wheel having a plurality of folding pocket boxes disposed along an outer periphery thereof, said rotary pocket wheel being supported for rotation about a center axis of said wheel, said method comprising the steps of:

placing a strip of wrapping material about an article, such that ends of said strip extend parallel to one another from parallel edges of said article, one of said ends being longer than the other of said ends;

wrapping each of said ends about said article such that a fin-like section containing each said end extends therefrom;

heat sealing the fin-like section together;

cooling the fin-like section; and sealing lateral ends of said strip about said article to complete the hermetic seal, said wrapping step including the additional steps of:

feeding said article into a first rotary folding box of said rotary pocket wheel and into a strip of wrapping material supported thereupon, said strip of wrapping material being sized to be fitted about the periphery of the article and including a pair of ends of dissimilar length extending from respective sides of the article wherein each rotary folding box of said rotary pocket wheel includes a pressure block rearward of said folding box;

rotating said pocket wheel so as to index said article to a second position wherein said rotating step folds each of the ends of the wrapping material strip rearwardly over an edge of the article and forms the fin-like section extending away from the article over said pressure block;

sealing said fin-like section while positioned over said pressure block; and folding the fin-like section onto said article as said article is removed from said rotary pocket wheel.

2. A method as recited in claim 1, further including the step of:

cutting a notch in a lateral end of said hermetically sealed article to permit easy opening of said package.

3. A method as recited in claim 1, wherein said rotary pocket wheel includes sealing means for performing said sealing step.

4. A method as recited in claim 3, wherein said sealing means includes at least one heater capable of being brought into proximity with a defined rotary folding box of said rotary pocket wheel for heat sealing the fin-like section of wrapping material brought into contact therewith.

5. A method as recited in claim 3, wherein said heat-sealing step does not require contact with the article being wrapped and in which heat and pressure are imparted only to the fin-like section.

6. A method as recited in claim 3, wherein said sealing step includes the step of ultrasonic sealing.

7. A method as recited in claim 1, wherein said cooling step includes the step of water chilling said seal, said cooling step being performed on said rotary wheel.

8. A method as recited in claim 1, wherein said end sealing step includes the step of folding said fin-like section of said article onto the top of said article to complete a hermetic seal of said article.

9. A method as recited in claim 1, including the additional steps of removing the article from the rotary pocket wheel and onto a conveyor, capturing the lateral ends of the article; and flattening the captured lateral ends of the article prior to the step of sealing the lateral ends of the article in order to complete the hermetic seal.

10. A method as recited in claim 9, wherein said capturing step includes the step of pushing said article through said conveyor such that each of said lateral ends are guided into slots formed therein.

11. A method as recited in claim 10, wherein said lateral end sealing step includes the step of heat-sealing the flattened lateral ends of said article.

* * * * *